United States Patent [19]

Beliveau

[11] Patent Number: 5,060,446

[45] Date of Patent: Oct. 29, 1991

[54] INSULATING WALL PANEL

[76] Inventor: Jean L. Beliveau, R.R. No. 3, Magog, Quebec, Canada, J1X 3W4

[21] Appl. No.: 586,249

[22] Filed: Sep. 21, 1990

[51] Int. Cl.[5] ..... E04C 3/02

[52] U.S. Cl. ..... 52/595; 52/241; 52/439; 52/594; 285/921

[58] Field of Search ..... 52/238, 239, 594, 595, 52/241, 243, 281, 284, 309.11; 285/921

[56] References Cited

U.S. PATENT DOCUMENTS

| | | | |
|---|---|---|---|
| 3,410,044 | 11/1968 | Moog | 52/439 |
| 3,449,879 | 6/1969 | Bloom . | |
| 4,069,632 | 1/1978 | Bode et al. . | |
| 4,163,349 | 8/1979 | Smith | 52/241 |
| 4,320,604 | 3/1982 | O'Hanlon . | |
| 4,920,722 | 5/1990 | Bosi | 52/594 |

FOREIGN PATENT DOCUMENTS

| | | | |
|---|---|---|---|
| 1047730 | 2/1979 | Canada . | |
| 1049217 | 2/1979 | Canada . | |
| 1116371 | 1/1982 | Canada . | |
| 1208871 | 8/1986 | Canada . | |
| 1220317 | 4/1987 | Canada . | |
| 19074 | 8/1912 | United Kingdom | 52/594 |

*Primary Examiner*—David A. Scherbel

*Assistant Examiner*—Kien Nguyen

*Attorney, Agent, or Firm*—Robic

[57] ABSTRACT

An insulating panel having at least one pair of opposite vertical sides defining opposite vertical interfaces for connection to other similar insulating panels abutting it. One of the opposite vertical interface includes a tongue and groove interlock consisting of at least three rows of aligned tongues and grooves, the three rows including first, second and third row adjacent to each other, the second row extending between the first and third rows, the aligned tongues and grooves of each of the rows being staggered with respect to the tongues and grooves of each adjacent row. The vertical interface opposite the one vertical interface includes a corresponding tongue and groove interlock consisting of a same number of rows of aligned tongues and grooves sized and positioned to engage and interfit with the rows of tongues and grooves of the one vertical interface of another similar insulating panel abutted to the panel so as to maximize a homogeneous force distribution along the adjacent interfaces of abutted panels and to act as a weather strip to prevent air circulation between the rows of tongues and grooves, thereby increasing the effective shearing strength as well as the effective insulation of the abutted panels.

15 Claims, 3 Drawing Sheets

INSULATING WALL PANEL

FIELD OF THE INVENTION

The present invention relates to insulating panels having male-female elements alternating along two of their sides.

BACKGROUND OF THE INVENTION

Insulating panels are known and have been described in, for instance, U.S. Pat. No. 3,449,879 as invented by BLOOM, wherein one longitudinal side defines a groove or slot and the other side a tongue so that a wall can be made by adjoining the tongue of one panel to the groove or slot of an adjacent panel. This system of grooved and tongued sides to build in mortices is extensively used. However, Applicant has found that in such systems made from foam products, such as insulating panels of expanded polystyrene and the like, the panels tend, for one reason or another, to slide with respect to each other and form uneven ends that are difficult to match with top sills.

SUMMARY OF THE INVENTION

Applicant has now found a way to obtain a better distribution of the force along the sides of building panels, particularly foam panels, so that if a force is exerted at a particular point, instead of disrupting the shape of the foam product, this force is evenly distributed. This is particularly advantageous for areas involving sills.

Broadly stated, the invention is directed to an insulating having at least one pair of opposite sides defining opposite interfaces for connection to other similar insulating panels abutting the insulating panel, one of the opposite interfaces including a tongue and groove interlock consisting of at least three rows of aligned tongues and grooves, said at least three rows including first, second, and third rows adjacent to each other, the second row extending between the first and third rows, the aligned tongues and grooves of each of the row being staggered with respect to the tongues and grooves of each adjacent row, the vertical interface opposite the one vertical interface including a corresponding tongue and groove interlock consisting of a same number of rows of aligned tongues and grooves sized and positioned to engage and interfit with the rows of tongues and grooves of the one vertical interface of another similar insulating panel abutted to the panel so as to maximize a homogeneous force distribution along the adjacent interfaces of the abutted panels and to act as a weather strip to prevent air circulation between said rows of tongues and grooves, thereby to increase the effective shearing strength as well as the effective insulation of the abutted panels.

Preferably, the panel is made from expanded insulating material such as polystyrene. In such a case, the panel may include plurality of framing members embedded in the insulating material, said members extending parallel to said lateral sides, to make it self-supporting.

BRIEF DESCRIPTION OF THE DRAWINGS

In the drawings which illustrate preferred embodiments of the invention.

DESCRIPTION OF THE PREFERRED EMBODIMENTS

Figure 1:
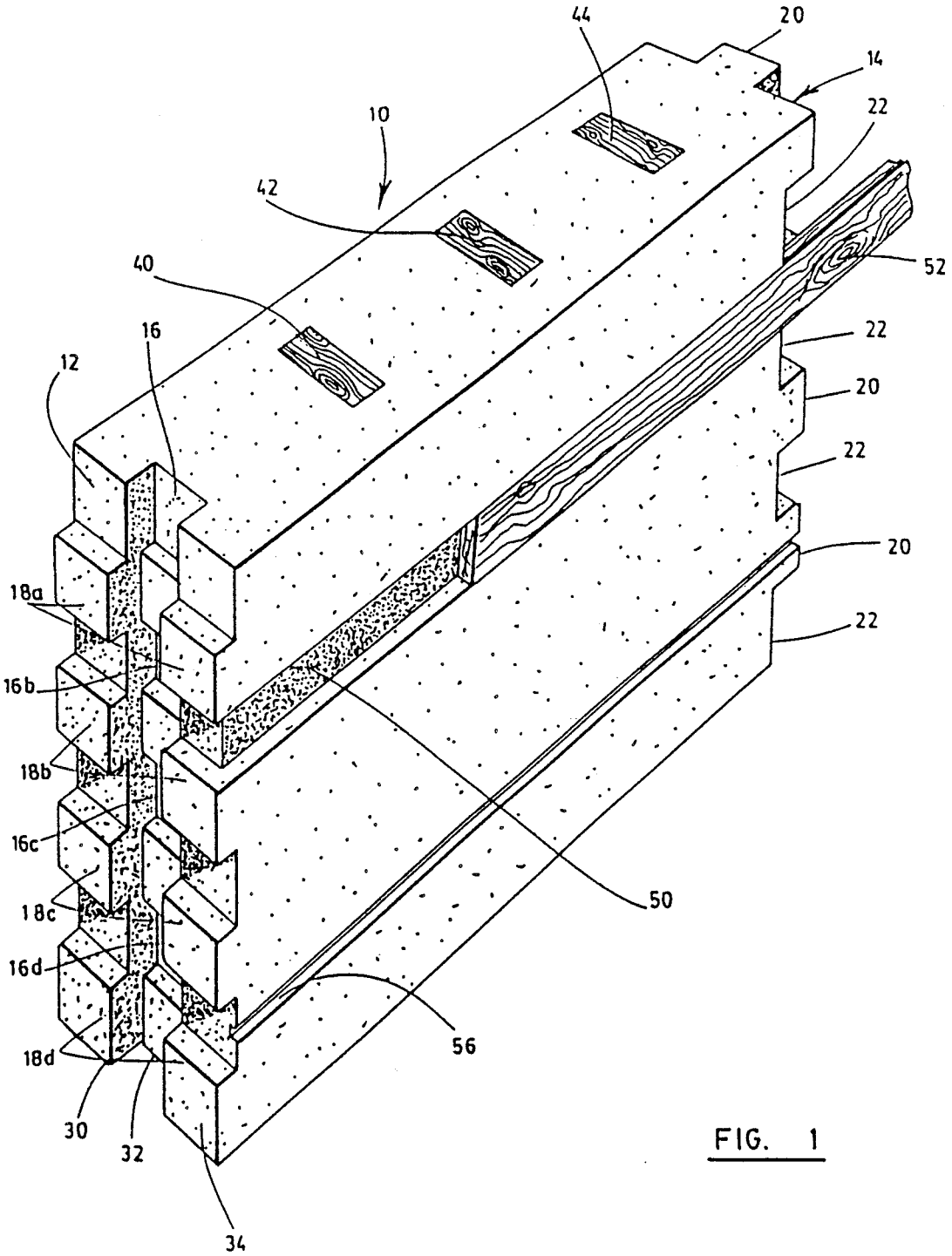
FIG. 1 is a perspective view of a panel according to the invention.
Figure 2:
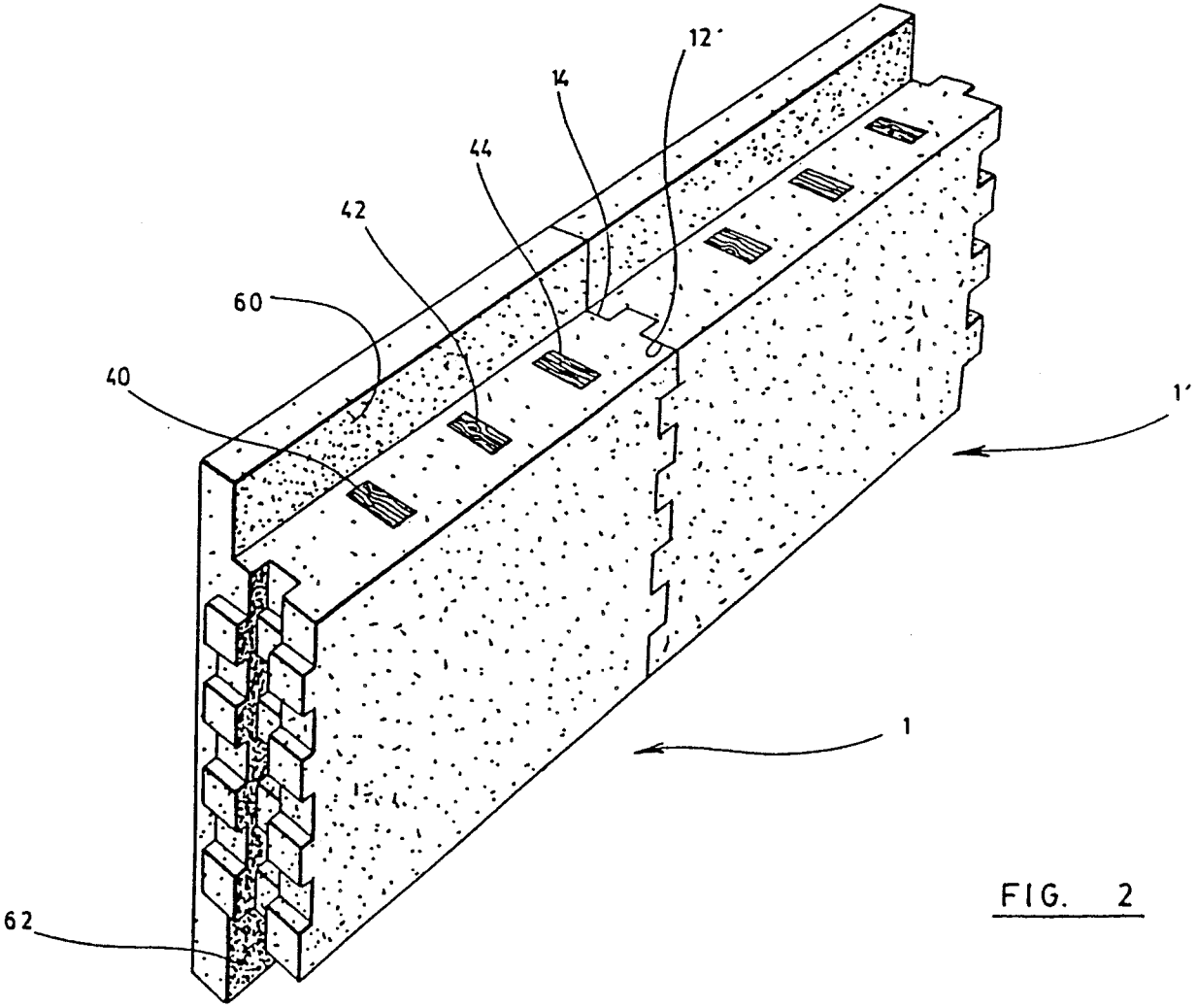
FIG. 2 is another perspective view illustrating similar panels provided with skirts and mounted to form a portion of a wall.
Figure 3A:
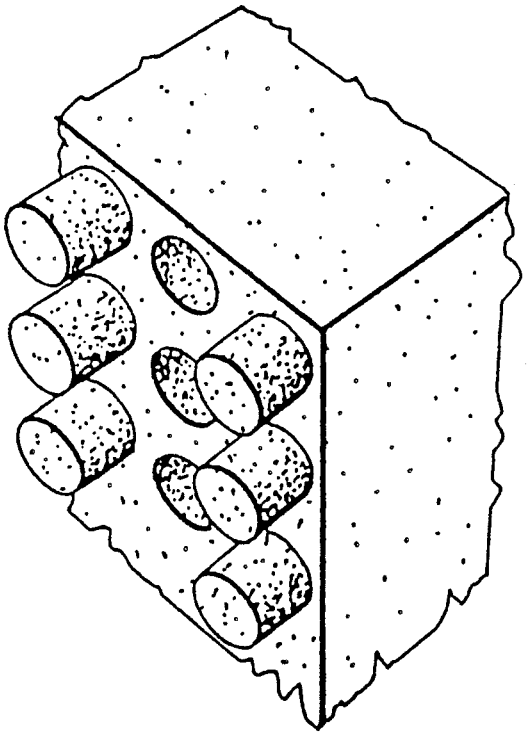
FIGS. 3*a* and 3*b* are perspective views of other kinds of male-female elements that could be used in the panel according to the invention.
Figure 3B:
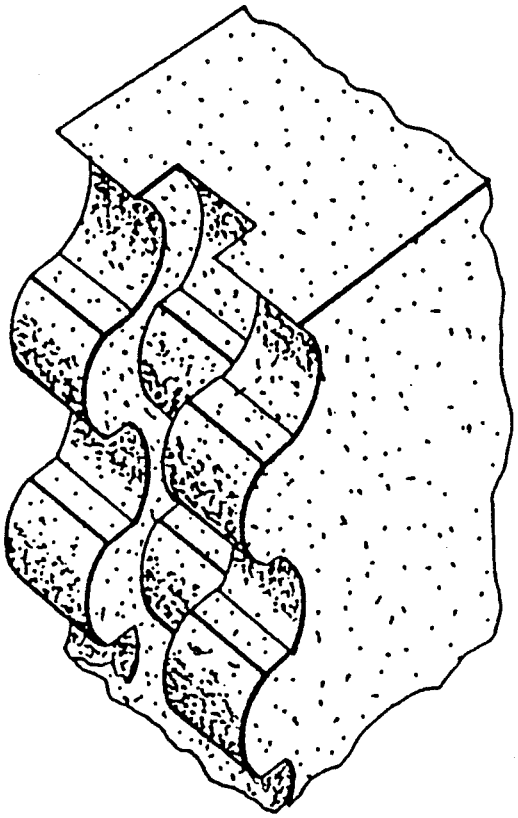

Referring to FIG. 1, an insulation panel 10 according to the invention is shown having four sides, two of which, preferably the lateral sides 12 and 14, extend parallel. One of the lateral sides 12 has in alternance at least one row of tongue slots 16*a*, 16*b*, 16*c*, 16*d* and protruding pegs 18*a*, 18*b*, 18*c*, 18*d* as to produce a toothed edge. The other longitudinal side 14 of said panel has in alternance at least a row of tongues or a plurality of pegs, said pegs 20 being in alternance with grooves or slots 22 so as to produce a toothed edge. Thus as seen in FIG. 2, the edge of one side such as 14 is able to engage the edge of the other side such as 12' of another similar panel in a tight fit relation, whereby the pegs anchor in between the slots and cooperate therewith to produce an homogeneous force distribution, thereby increasing the effective shearing strength of the insulating panel.

Preferably, as shown in FIG. 1, the toothed edges are square as shown at 18*a, b, c, d.* They could if desired take other shapes. For instance, they may be pyramidally troncated and correspondingly the pegs, although the square configuration is preferred.

Preferably, each slot is rectangular in shape and sized to receive a similarly shaped peg.

Preferably also, the pegs as shown at 20, have square surfaces and are aligned longitudinally, with the sides of the pegs being of the same dimension as the width of the row.

The longitudinal side may have a single row although a plurality of rows containing slots and pegs in alternance is preferred.

The rows preferably are staggered with respect to one another so that the slot of a first row is adjacent to the peg of the next row and the peg of the next row is adjacent the slot the following row as shown at 30, 32 and 34 respectively.

Preferably the panels are made from expandable material expandable polystyrene. Any foam material having the desired strength and heat conductivity characteristics may be used if desired.

These panels provided with slots and pegs prevent slipping between them when mounted in side-to-side relationship to form a wall. Instead of slots and pegs, other kind of male-female elements may be used if desired such as semicircular pr cylindrically shaped elements. Also these elements need not be in row.

The insulating panel is also preferably molded with a plurality of elongated framing members such as shown at 40, 42 and 44 which are completely embedded within the insulating material over most of their height. The panel 10 may be provided as shown in FIG. 2 with slots or grooves 50 on at least one of its lateral surfaces to receive a plurality of wooden laths such as shown at 52. Slots may also be provided such as 56 for wires and grooves 50 may be provided for carrying pipes or other electrical wires, as may be desired.

In FIG. 2, the insulating panel is provided with a skirt 60. A wooden lath may be nailed to wooden beam 40, 42, 44 if one so wishes.

The skirt 60 may be provided if desired to extend over an upper sill, in a case of an upper skirt, or over a lower sill in the case of a lower skirt (see 60).

Although the present invention has been explained hereinabove by way of preferred embodiments thereof, it should be pointed out that any modifications to these preferred embodiments, within the scope of the appended claims, is not deemed to change or alter the nature and scope of the invention.

The embodiments of the invention in which an exclusive property or privilege is claimed are defined as follows:

1. An insulating panel having at least one pair of opposite vertical sides defining opposite vertical interfaces for connection to other similar insulating panels abutting said insulating panel, one of said opposite vertical interfaces including a tongue and groove interlock consisting of at least three rows of aligned tongues and grooves, said at least three rows including first, second and third rows adjacent to each other, the second row extending between the first and third rows, the aligned tongues and grooves of each of said rows being staggered with respect to the tongues and grooves of each adjacent row, the vertical interface opposite said one vertical interface including a corresponding tongue and groove interlock consisting of a same number of rows of aligned tongues and grooves sized and positioned to engage and interfit with the rows of tongues and grooves of the one vertical interface of another similar insulating panel abutted to said panel so as to maximize a homogeneous force distribution along the adjacent interfaces of said abutted panels and to act as a weather strip to prevent air circulation between said rows of tongues and grooves, thereby to increase the effective shearing strength as well as the effective insulation of said abutted panels.

2. An insulating panel as defined in claim 1 wherein said panel is rectangular and vertical and said pair of opposite sides forming said opposite vertical interfaces are the vertical sides of said rectangular panel.

3. The panel as defined in claim 2, further having at least one longitudinal skirt.

4. The panel as defined in claim 2, further having two longitudinal skirts.

5. The panel as defined in claim 2 wherein the tongues of each row are square and extend over the width of said row.

6. The panel as defined in claim 1 wherein each of said opposite interfaces includes three rows of aligned tongues and grooves extending in parallel relationship.

7. The panel as defined in claim 6 wherein said first and third rows of each opposite interface have similarly positioned tongues and grooves, the second row between said first and third rows having tongues and grooves staggered with respect to those of said first and second rows.

8. The panel as defined in claim 1, wherein said panel is made from expanded insulating material.

9. The panel as defined in claim 8, wherein said panel includes a plurality of framing members embedded in the insulating material, said members extending parallel to said lateral sides.

10. The panel as defined in claim 8, wherein said panel has at least one outer surface provided with a set of longitudinal grooves and slots.

11. The panel as defined in claim 8, wherein said panel includes a plurality of framing members embedded in the insulating material, said members extending parallel to said lateral sides and has at least one outer surface provided with a set of longitudinal grooves and slots.

12. The panel as defined in claim 15, wherein the tongues of each row are square and extend over the width of said row.

13. The panel as defined in claim 11 wherein each of said opposite interfaces includes rows of aligned tongues and grooves extending in parallel relationship.

14. The panel as defined in claim 13, wherein said first and third rows of each opposite interface have similarly positioned tongues and grooves, the second row between said first and third rows having tongues and grooves staggered with respect to those of said first and second rows.

15. The panel as defined in claim 1, wherein said panel is made from expanded polystyrene.

* * * * *